United States Patent [19]

Ooi et al.

[11] Patent Number: 5,017,897

[45] Date of Patent: May 21, 1991

[54] SPLIT RING RESONATOR BANDPASS FILTER WITH DIFFERENTIAL OUTPUT

[75] Inventors: Leng H. Ooi; Peter J. Yeh, both of Sunrise; Branko Avanic, Coral Gables, all of Fla.

[73] Assignee: Motorola, Inc., Schaumburg, Ill.

[21] Appl. No.: 562,971

[22] Filed: Aug. 6, 1990

[51] Int. Cl.[5] ..... H01P 1/203

[52] U.S. Cl. ..... 333/204; 333/219; 445/327

[58] Field of Search ..... 333/219, 219.1, 202–205, 333/246, 120; 455/326, 327, 332

[56] References Cited

U.S. PATENT DOCUMENTS 4,749,963 6/1988 Makimoto et al. ..... 333/246 X

FOREIGN PATENT DOCUMENTS 0038304 2/1988 Japan ..... 333/204

OTHER PUBLICATIONS

Makimoto et al., Varactor Tuned Bandpass Filters Using Microstrip-Line Ring Resonators, *IEEE MTT-S Digest* (1986), at pp. 411–414.

*Primary Examiner*—Eugene R. LaRoche
*Assistant Examiner*—Seung Ham
*Attorney, Agent, or Firm*—Michael J. Buchenhorner

[57] ABSTRACT

A bandpass filter (40) comprises a first microstrip split-ring resonator (12), having at least a first edge and a second edge, the first edge having a gap (20) therein, and an input. The bandpass filter (40) also comprises a second microstrip split-ring resonator (14), having at least a first edge and a second edge, the first edge being coupled to the second edge of the first microstrip split-ring resonator, and the second edge of the second microstrip split-ring resonator comprising a gap (26) therein and a balanced output (30, 32).

12 Claims, 2 Drawing Sheets

SPLIT RING RESONATOR BANDPASS FILTER WITH DIFFERENTIAL OUTPUT

TECHNICAL FIELD

This invention relates generally to bandpass filters (BPFs) and more specifically to BPFs using split ring resonators.

BACKGROUND

Microstrip ring resonators are now used in bandpass filter applications to overcome the influence that parasitic components generated at short circuited points in resonators have on circuit losses and resonance frequencies. Referring to FIG. 1, a conventional split-ring resonator BPF 10 is shown. The BPF 10, having a single-ended input port and a double-ended output port, comprises a first split-ring resonator 12, and a second split-ring resonator 14. The first and second split-ring resonators 12 and 14 each have a gap 20 and 26, respectively, therein. A capacitor ($C_t$) 18 is connected across gap 20, and a capacitor ($C_t$) 24 is connected accross gap 26 to decrease the size of the resonators. A signal may be applied to the BPF through a capacitor ($C_c$) 16. The signal is filtered by the BPF 10 and the resulting filtered signal is provided at the output of the BPF 10 through a capacitor ($C_c$) 28. There are applications for such BPFs that require that the output or input of the BPF 10 be coupled to a component requiring a balanced input or output. For example, if the BPF 10 were to be coupled to a balanced mixer (i.e., a balanced input is required by the mixer) a transformer would generally be used to provide a balanced output. Thus, it would be advantageous to have a split-ring resonator filter having a balanced output port or a balanced input port, or to have a balanced input port and a balanced output port.

SUMMARY OF THE INVENTION

Briefly, according to the invention, a BPF, having an input port and an output port, comprises first and second split-ring resonators. The first split-ring resonator is coupled to the input port of the BPF, and the second split-ring resonator is coupled to the first split-ring resonator, and to the output port of the BPF. According to the invention, the second split-ring resonator comprises a balanced output port. Additionally, the first split-ring resonator may comprise a balanced input port.

DETAILED DESCRIPTION OF THE PREFERRED EMBODIMENT

Figure 1:
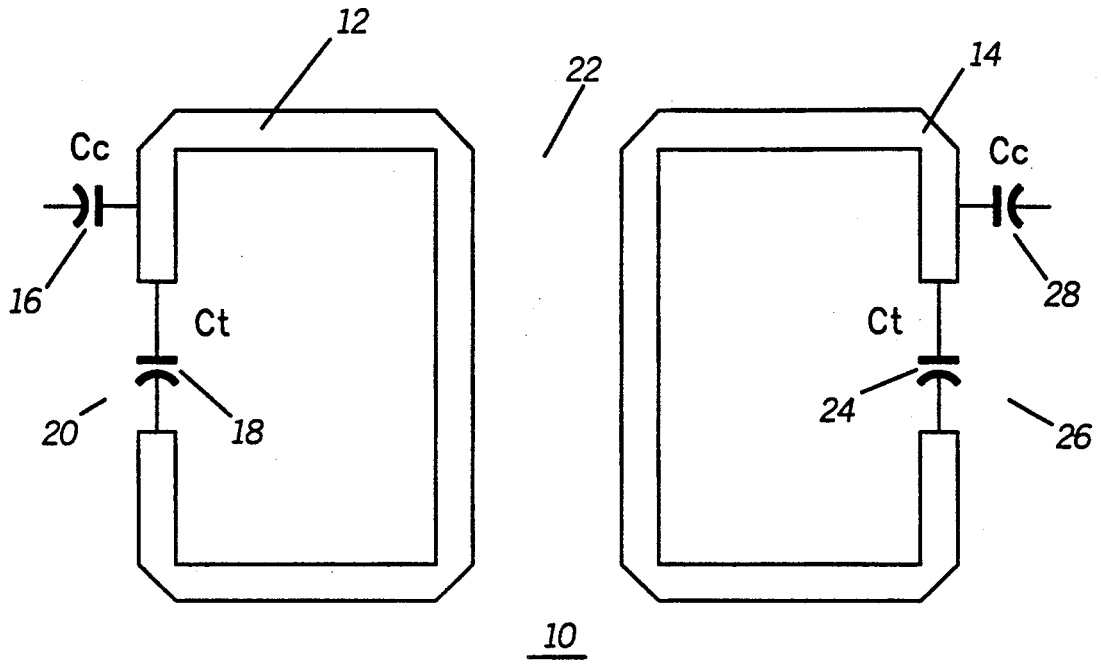
FIG.1 (PRIOR ART)
FIG. 1 shows a conventional split-ring resonator BPF having a single-ended input port, and a single-ended output port.
Figure 2:
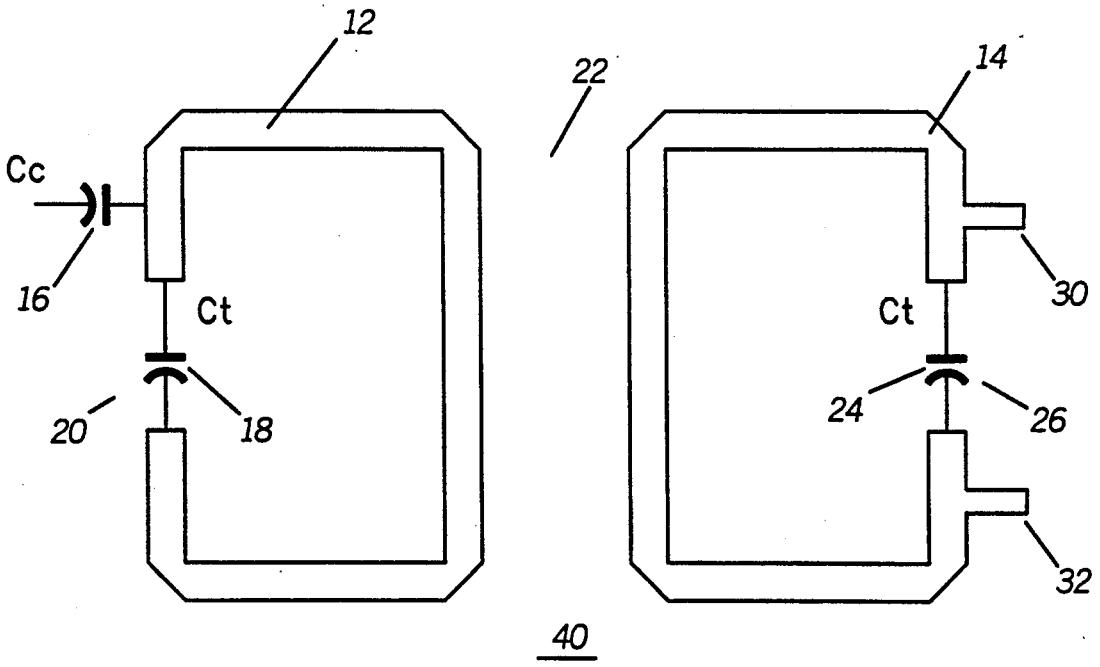
FIG. 2 shows a BPF having a single-ended input port, and a differential-ended output port in accordance with the invention.

Referring to FIG. 2, a split-ring microstrip or stripline resonator bandpass filter 40, having a single-ended input port and a balanced (or differential) output port, in accordance with the invention is shown. The BPF 40 is identical to the BPF 10, except that output terminals

30 and 32 are substituted for the output capacitor 28, thus providing a balanced output port. Due to the nature of the coupling 22 (i.e., magnetic), and the length of the line, a single-ended to differential-ended BPF is achieved by choosing the locations of the first output terminal 30 and of the second output terminal 32 so that the second output terminal 32 is at a symmetric end in the opposite side of the gap 26. Moreover, the coupling capacitor 28 in the conventional split-ring resonator 10 could be eliminated for quadrature output, or the output or input tap positions could be replaced with capacitors which could be trimmed to adjust the phase balance. In this configuration an impedance jump is possible due to the nature of the structure of the split-ring microstrip resonator 40.

Figure 3:
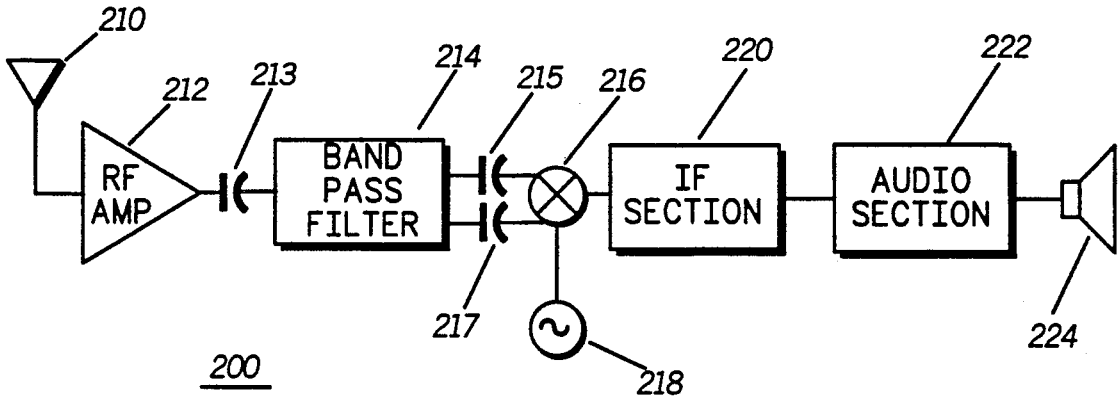
FIG. 3 shows a block diagram of a radio in accordance with the invention.

Referring to FIG. 3, a radio 200 is shown incorporating the RF filter 214 in accordance with the invention. A radio-frequency signal is received at a conventional antenna 210 and amplified by the RF amplifier 212 (an initial bandpass filter coupled from the antenna 210 to the amplifier 212 would also be advantageous). A BPF 214 in accordance with the invention is coupled from the amplifier 212 to the mixer 216 (through a capacitor 213). The BPF 214 also has its balanced output port coupled to the balanced input port of the mixer 216 (through capacitors 215 and 217). The signal is then mixed with a reference signal provided by a conventional local oscillator 218 to produce an intermediate frequency (IF) signal. The IF signal is then applied to a conventional IF section 220 where it is processed and demodulated to produce an audio signal. The audio signal is then applied to a conventional audio section 222 and presented to a listener by a conventional speaker 224.

Employing the BPF 214 in such an application improves the performance of the radio 200. However, it will be appreciated that the invention may be advantageously used in other RF parts of radio receivers or transmitters.

Figure 4:
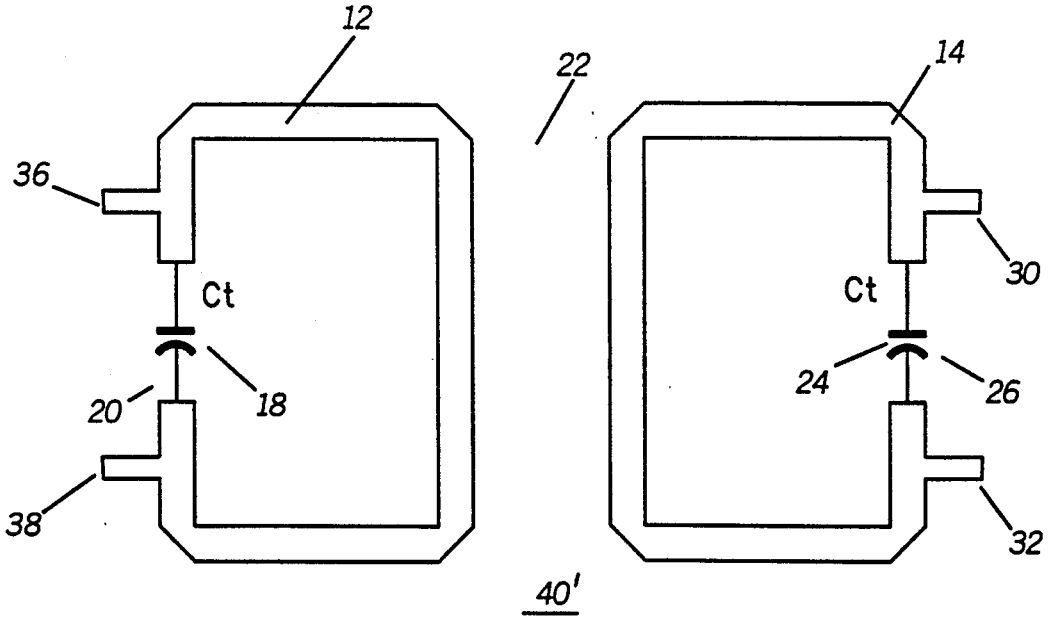
FIG. 4 shows a BPF having a differential-ended input port, and a differential-ended output port in accordance with the invention.

Referring to FIG. 4, an alternative embodiment of the invention is shown wherein the BPF 40' has a balanced input port and a balanced output port. This is accomplished by eliminating the capacitive input 16 from BPF 40 and introducing terminals 36 and 38 in a manner similar to that used for introduction of the balanced output port of FIG. 2 (and FIG. 4). There are situations where a BPF is required with both a balanced input and a balanced output. By appropriate choice of the location of the taps 36 and 38 the desired phase difference across the inputs may be achieved.

What is claimed is:

1. A bandpass filter comprising:

a first port;

a first microstrip split-ring resonator, having at least a first edge and a second edge, the first edge having a gap therein, and the first edge being coupled to the first port;

a second microstrip split-ring resonator, having at least a first edge and a second edge, the first edge being coupled to the second edge of the first microstrip split-ring resonator, and the second edge of the second microstrip split-ring resonator comprising a gap therein;

a second port coupled to the second edge of the second microstrip split-ring resonator, the second port comprising a first terminal located at one side of the gap in the second edge of the second microstrip split-ring resonator, and a second terminal symmetrically located at the other side of the gap in the second edge of the second microstrip split-ring resonator.

2. The bandpass filter of claim 1, further comprising a first capacitor coupled across the gap in the first microstrip split-ring resonator.

3. The bandpass filter of claim 1, further comprising a second capacitor coupled across the gap in the second microstrip split-ring resonator.

4. The bandpass filter of claim 1, wherein the first port comprises a first terminal located at one side of the gap in the first edge of the first microstrip split-ring resonator.

5. The bandpass filter of claim 1, wherein the first port comprises a second terminal symmetrically located at the other side of the gap in the first edge of the first microstrip split-ring resonator.

6. A communication device comprising:

receiver means for receiving radio-frequency signals;

a bandpass filter, coupled to the receiver means, comprising:

a first port;

a first microstrip split-ring resonator, having at least a first edge and a second edge, the first edge having a gap therein, and the first edge being coupled to the first port;

a second microstrip split-ring resonator, having at least a first edge and a second edge, the first edge being coupled to the second edge of the first microstrip split-ring resonator, and the second edge of the second microstrip split-ring resonator comprising a gap therein;

a second port coupled to the second edge of the second microstrip split-ring resonator, the second port comprising a first terminal located at one side of the gap in the second edge of the second microstrip split-ring resonator, and a second terminal symmetrically located at the other side of the gap in the second edge of the second microstrip split-ring resonator.

7. The communication device of claim 6, wherein said bandpass filter further comprising a first capacitor coupled across the gap in the first microstrip split-ring resonator.

8. The communication device of claim 6, wherein said bandpass filter further comprising a second capacitor coupled across the gap in the second microstrip split-ring resonator.

9. The communication device of claim 6, wherein the first port comprises a first terminal located at one side of the gap in the first edge of the first microstrip split-ring resonator.

10. The communication device of claim 6, wherein the first port comprises a second terminal symmetrically located at the other side of the gap in the first edge of the first microstrip split-ring resonator.

11. The communication device of claim 6 further comprising a frequency mixer having a balanced input coupled to the balanced output of the bandpass filter.

12. The communication device of claim 6 wherein the communication device is a radio.

* * * * *